US007044769B2

(12) United States Patent
Zhao et al.

(10) Patent No.: US 7,044,769 B2
(45) Date of Patent: May 16, 2006

(54) ELECTRICAL CONNECTOR WITH SEATING INDICATOR

(75) Inventors: Tiebin Zhao, Medina, OH (US); Jefferson Wang, Aiken, SC (US); James F. Cameron, Evans, GA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/721,823

(22) Filed: Nov. 26, 2003

(65) Prior Publication Data

US 2005/0112934 A1 May 26, 2005

(51) Int. Cl.
*H01R 3/00* (2006.01)

(52) U.S. Cl. ..... 439/489; 439/921; 439/680

(58) Field of Classification Search ..... 439/488, 439/489, 491, 181, 921, 680
See application file for complete search history.

(56) References Cited

U.S. PATENT DOCUMENTS

RE31,462 E * 12/1983 McCornick et al. ..... 439/680
4,695,110 A * 9/1987 Wasserlein ..... 439/289
4,759,730 A * 7/1988 Sappington et al. ..... 439/622
4,795,375 A * 1/1989 Williams ..... 439/680
6,504,103 B1 * 1/2003 Meyer et al. ..... 174/167
6,733,343 B1 * 5/2004 Morita et al. ..... 439/680
2004/0157498 A1 * 8/2004 Hall et al. ..... 439/680

* cited by examiner

*Primary Examiner*—Hien Vu
(74) *Attorney, Agent, or Firm*—Alfred N. Goodman; Mark S. Bicks

(57) ABSTRACT

An electrical connector includes a body with first and second end sections, a mid-section disposed between the first and second end sections. The mid-section is radially larger than each of the first and second end sections and includes an outer surface. A transition shoulder is disposed between the first end section and the mid-section. The transition shoulder includes a face wall extending between the outer surface of the mid-section and an outer surface of the first end section. A plurality of radial indicator ribs extend from the outer surface of the mid-section. Each of the radial indicator ribs includes an abutment surface laterally offset from the face wall of the transition shoulder to abut or almost abut a portion of a mating electrical connector.

20 Claims, 3 Drawing Sheets

ELECTRICAL CONNECTOR WITH SEATING INDICATOR

FIELD OF THE INVENTION

The present invention generally relates to an electrical connector with a seating indicator for indicating proper connection with a mating electrical connector. More specifically, the electrical connector includes a plurality of radial ribs that abut the mating electrical connector, thereby providing a visual indication of proper mating between the two connectors.

BACKGROUND OF THE INVENTION

Conventional mating electrical connectors employ a ring or band disposed on one of the connectors to provide a visual indication of proper connection between the two mating electrical connectors. The ring is typically either molded into the connector or formed separately and slid onto the connector. For example, U.S. Pat. No. 6,213,799 to Jazowski, the subject matter of which is herein incorporated by reference, discloses a bushing insert 10 and mating elbow connector 12 with a ring 100 disposed on a shoulder 22 of bushing insert 10. Ring 100 is brightly colored and is obscured by cuff 28 of elbow connector 12 when bushing insert 10 and elbow connector 12 are properly connected, thereby providing a visual indication of proper mating.

U.S. Pat. No. 6,504,103 to Meyer et al., the subject matter of which is herein incorporated by reference, discloses a bushing insert 112 that includes a color band 114 in its shoulder. Band 114 is obscured by an end flange 124 of an elbow terminator 100, thereby indicating that elbow terminator 100 and bushing insert 112 are properly mated. U.S. Pat. No. 5,795,180 to Siebens, the subject matter of which is herein incorporated by reference, discloses a bushing insert 72' that includes an elbow seating band 100 disposed in a recess 114 of insert 72'. Elbow seating band 100 is formed of a brightly colored material.

However, these conventional mating electrical connectors require the operator to move to the side of the assembly of the electrical connectors to observe whether the ring or band is obscured and confirm proper mating of the connectors. Also, these conventional electrical connectors require the manufacture of ring in addition to the electrical connector, thereby increasing manufacturing time and costs.

SUMMARY OF THE INVENTION

Accordingly, an object of the present invention is to provide an electrical connector with a seating indicator for visually indicating proper connection with a mating electrical connector.

Another object of the present invention is to provide an electrical connector with a seating indicator that can be observed from either the side or end of the connector assembly to indicate proper connection with a mating electrical connector.

Yet another object of the present invention is to provide an electrical connector with a seating indicator that is easier and less expensive to manufacture.

The foregoing objects are basically attained by an electrical connector including a body with first and second end sections, and a mid-section disposed between the first and second end sections. A mid-section is radially larger than each of the first and second end sections and includes an outer surface. A transition shoulder is disposed between the first end section and the mid-section. The transition shoulder includes a face wall extending between the outer surface of the mid-section and an outer surface of the first end section. A plurality of radial indicator ribs extend from the outer surface of the mid-section. Each of the radial indicator ribs includes an abutment surface laterally offset from the face wall of the transition shoulder and is adapted to abut a portion of a mating electrical connector.

The foregoing objects are also attained by an electrical connector including a body with first and second end sections, a mid-section disposed between the first and second end sections, the mid-section being radially larger than each of the first and second end sections and including an outer surface, and a transition shoulder disposed between the first end section and the mid-section. The transition shoulder includes a face wall extending between the outer surface of the mid-section and an outer surface of the first end section. A radial indicator rib extends from the outer surface of the mid-section. The radial indicator rib includes an abutment surface laterally offset from and substantially parallel to the face wall of the transition shoulder defining a step adapted to receive a portion of a mating electrical connector with substantially no space between the portion of the mating electrical connector and the abutment surface of the radial indicator rib.

The foregoing objects are also attained by an electrical connector assembly including a first electrical connector having a body with first and second end sections and a mid-section disposed between the first and second end sections. The mid-section being radially larger than each of the first and second end sections and including an outer surface, and a transition shoulder disposed between the first end section and the mid-section. The transition shoulder includes a face wall extending between the outer surface of the mid-section and an outer surface of the first end section. A radial indicator rib extends from the outer surface of the mid-section. The radial indicator rib includes an outer surface and an abutment surface laterally offset from the face wall of the transition shoulder defining a step. A second electrical connector includes a port receiving the first end section of the first electrical connector and a cuff terminating the port. The cuff is received in the step of the first connector with a portion of the cuff abutting the abutment surface of the radial indicator rib.

The foregoing objects are also attained by a method of mating first and second electrical connectors. The first connector includes first and second end sections with a mid-section therebetween and a transition shoulder disposed between the first end section and the mid-section. The second connector includes a port sized to accommodate the first end section of the first electrical connector and a cuff terminating the port. The method includes inserting the first end of the first electrical connector into the port of the second electrical connector and covering an outer surface of the transition shoulder of the first electrical connector with the cuff of the second electrical connector. The method also includes abutting a surface of the cuff of the second electrical connector with an abutment surface of a radial indicator rib extending from an outer surface of the mid-section of the first electrical connector and laterally offset from the transition shoulder of the first electrical connector, thereby indicating proper mating between the first and second connectors.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Referring to FIGS. 1–4, an electrical connector 10 in accordance with the present invention includes a plurality of radially extending indicator ribs 12, 14 and 16 which provide a visual indication of proper mating of a first electrical connector 10 with a second electrical connector 18. Upon connection, electrical connector 10 and electrical connector 18 form an electrical connector assembly 20 and the minimum distance, that is little or no space, between indicators ribs 12, 14 and 16 of connector 10 and the second electrical connector 18, indicating proper mating.

Electrical connector 10 can be any type of electrical connector adapted to be mated with a second electrical connector. For example, electrical connector can be a high voltage bushing insert that mates with a high voltage elbow cable connector. The general structure of a bushing insert and a cable connector are disclosed in commonly owned U.S. Pat. No. 6,213,799 to Jazowski et al.

Figure 1:
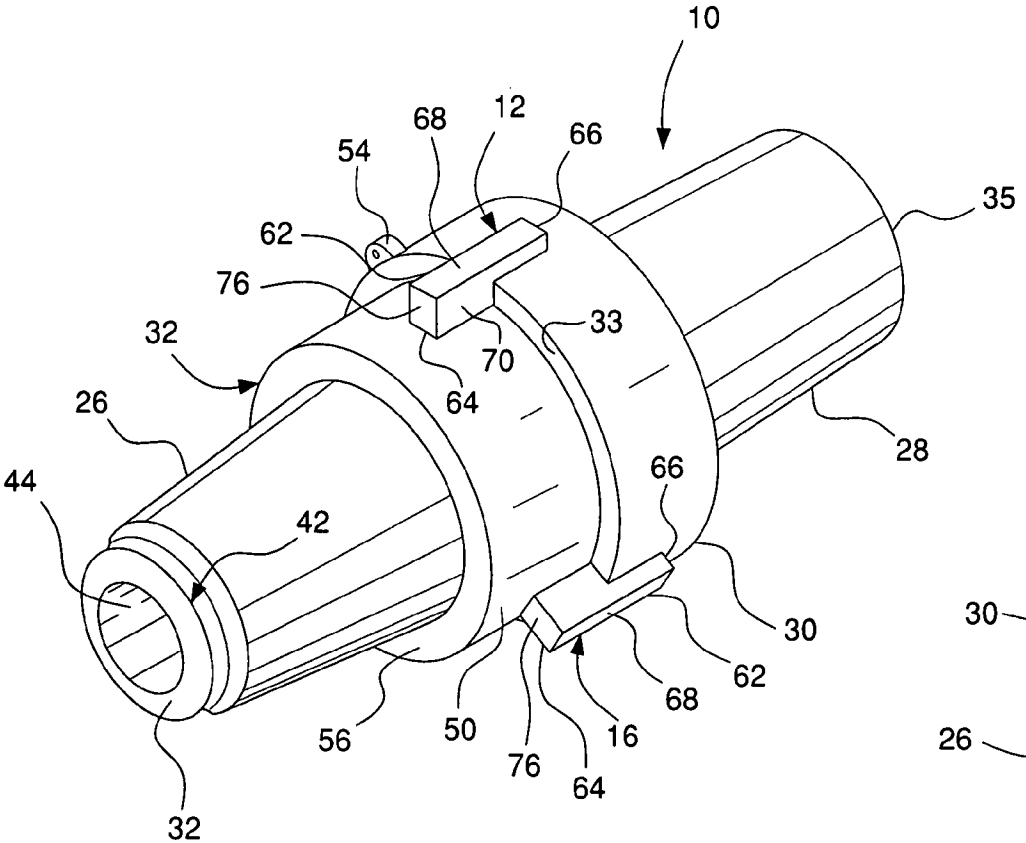
FIG. 1 is a perspective view of a first electrical connector in accordance with an embodiment of the present invention.
Figure 3:
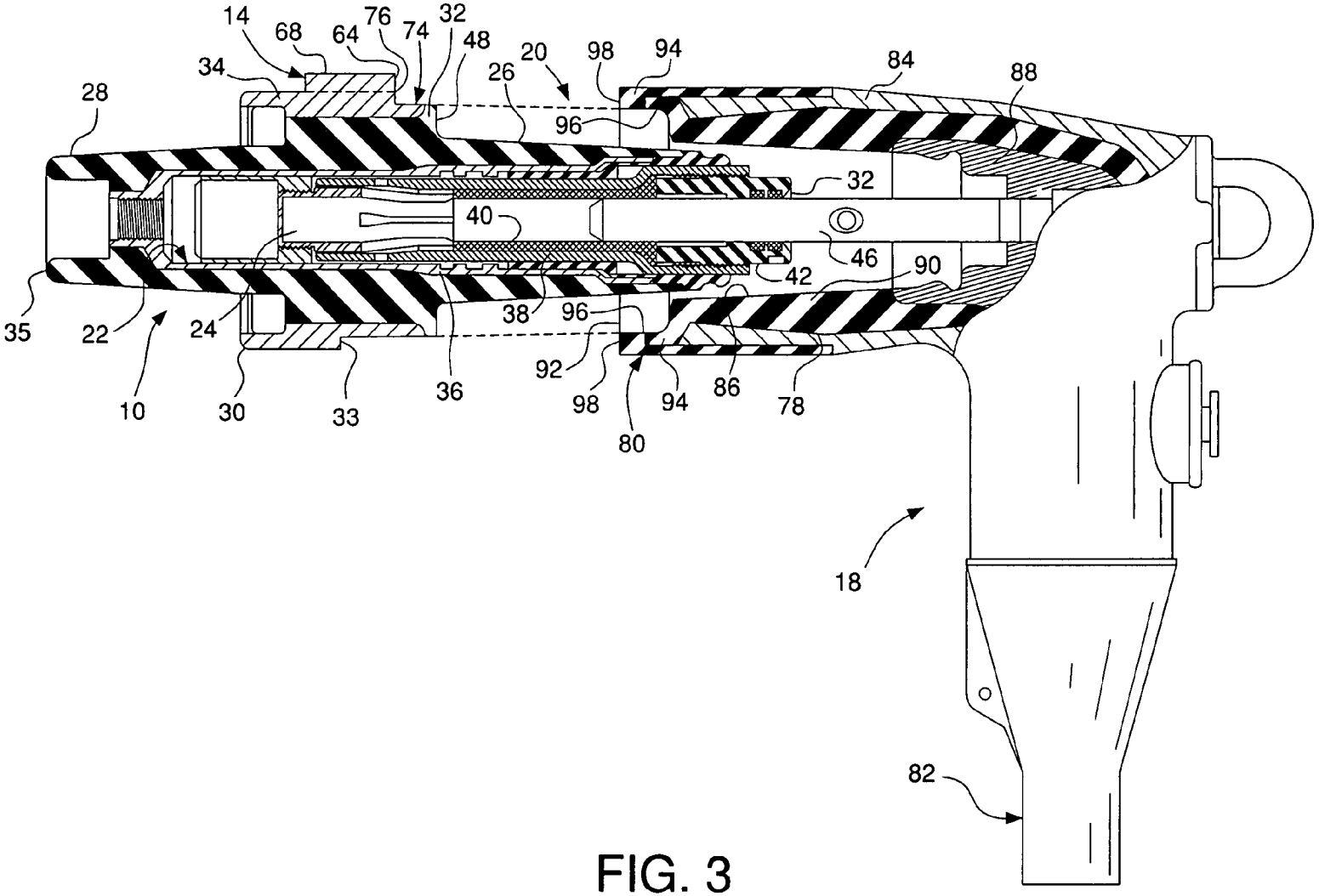
FIG. 3 is a side elevational view of an electrical connector assembly in section in accordance with an embodiment of the present invention, showing the electrical connector illustrated in FIG. 1 being connected to a mating electrical connector and before reaching its fully mated position.
Figure 4:
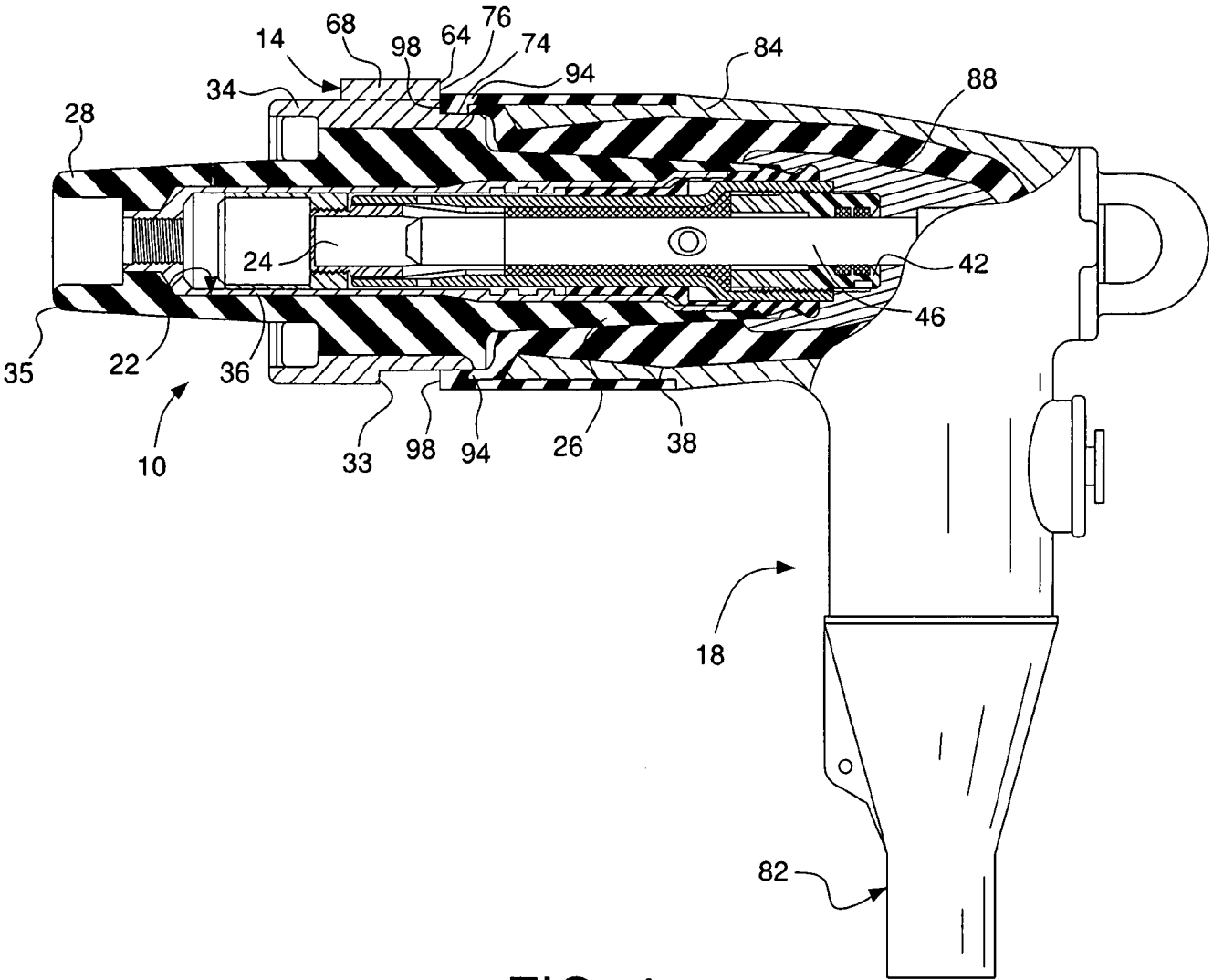
FIG. 4 is a side elevational view similar to FIG. 3, showing the electrical connector assembly fully mated.

Electrical connector 10 specifically includes a body 20 having an inner bore 22 that receives a conventional female contact assembly 24, as best seen in FIGS. 3 and 4. Body 20 includes opposing first and second end sections 26 and 28, and a mid-section 30 that joins sections 26 and 28. First end section 26 connects to second electrical connector 18, second end section 28 connects to a bushing well (not shown) and mid-section 30 connects to ground, as is well known in the art. First and second end sections 26 and 28 are generally cylindrical with a slight taper from mid-section 30 to the respective ends 32 and 35 of body 20. First end section 26 is shaped to fit within second electrical connector 18, as seen in FIG. 4. Mid-section 30 is radially wider than first and second end sections 26 and 28 with a transition shoulder 32 disposed between mid-section 30 and first end section 26, as seen in FIG. 1. Mid-section 30 has a secondary shoulder 33 dividing mid-section 30.

Body 20 of electrical connector 10 is formed of an insulative or dielectric material with an outer conductive layer or shield 34 located at mid-section 30, and an inner conductive casing 36 that defines inner bore 22, as seen in FIGS. 3 and 4. Received within inner bore 22 is a non-conductive insert casing 38 having female contact assembly 24 and an albative member 40 that provides arc quenching gases supported within casing 38. Insert casing 38 is generally tubular and includes an end piece 42 with an access opening 44 for receiving an electrical contact 46, such as a probe, of second electrical connector 18. Outer conductive layer 34 is preferably made of a conductive rubber, insulative body 20 is preferably made of an insulating rubber, inner casing 36 and female contact assembly 22 are preferably made of metal, such as copper, and non-conductive insert casing 38 is preferably made of a polymer such as plastic.

As seen in FIGS. 3 and 4, outer conductive layer 34 covers and encloses most of mid-section 30 with a lip 48 of insulative body 20 forming transition shoulder 32. Outer conductive layer 34 is preferably a unitary one-piece layer that includes an outer surface 50. Ground connections (only one shown in FIG. 1) 54 are formed in outer conductive layer 34 and extend from outer surface 50. Ground connections 54 allow electrical connector 10 to be connected to ground, as is well known in the art. Ground connections 54 can be separate or unitary with radial indicator ribs 12, 14 and 16.

Figure 2:
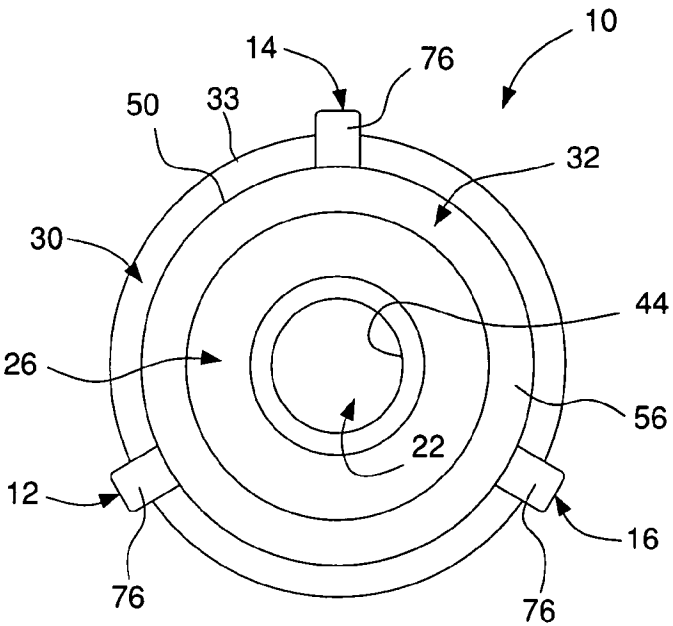
FIG. 2 is an end elevational view of the first electrical connector illustrated in FIG. 1.

As seen in FIGS. 1 and 2, radial indicator ribs 12, 14 and 16 of electrical connector 10 extend radially outwardly from mid-section 30. Ribs 12, 14 and 16 can be either molded into conductive shield 34 of mid-section 30 or formed separately and attached to shield 34. Each radial indicator rib 12, 14 and 16 is laterally offset or spaced from the face wall 56 of transition shoulder 32 of connector 10. Face wall 56 extends between the outer surface 58 of first end section 26 and the outer surface 50 of mid-section 30, as seen in FIG. 1. Each radial indicator rib 12, 14 and 16 includes an elongated body 62 with first and second end walls 64 and 66 and an outer wall 68 extending between first and second end walls 64 and 66. Opposite sidewalls 70 and 72 also extend between end walls 64 and 66. Ribs 12, 14 and 16 can extend over secondary shoulder 33. First end wall 64 of each rib 12, 14 and 16 faces the same direction as face wall 56 of transition shoulder 30 and is generally parallel therewith. A step 74 is defined between each of first end walls 64 of ribs 12, 14 and 16 and face wall 56, as best seen in FIG. 3. Each first end wall 64 includes an abutment surface 76 for abutting second electrical connector 18. Each abutment surface 76 is laterally offset relative face wall 56, i.e. is spaced along the longitudinal axis of connector 10 from face wall 56.

As seen in FIGS. 3 and 4, second electrical connector 18, such as an elbow cable connector, includes an insulative housing 78 with first and second ends 80 and 82, and an outer conductive jacket 84. First end 80 includes a bushing port 86 for receiving first end section 26 of electrical connector 10 including an end section shaped to receive end piece 42 of casing 38 of electrical connector 10. Extending through bushing port 86 is electrical contact or conductive probe 46 adapted for connection to female contact assembly 24 located in inner bore 22 and casing 38 of electrical connector 10. Probe 46 can include an albative member, as is well known in the art. Second end 82 of second electrical connector 18 receives a cable that is electrically connected to probe 46 via a conductive insert 88.

Bushing port 86 is defined by an inner non-conductive or dielectric layer 90 with conductive insert 88 at one end and an access opening 92 opposite conductive insert 88. Surrounding access opening 92 is a terminal cuff 94 of non-conductive layer 90. Terminal cuff 94 includes a connector interface inner surface 96 and an end wall 98, as best seen in FIG. 3.

Assembly and Operation

Referring to FIGS. 3 and 4, first electrical connector 10 is inserted into second electrical connector 18 at port 86 forming an interference fit therewith. As seen in FIG. 3, first end section 26 of connector 10 fits completely within port 86 of second connector 18. Terminal cuff 94 extends past transition shoulder 32 of electrical connector 10 so that connector interface inner surface 96 of cuff 94 covers the outer surface 50 of mid-section 30 at transition shoulder 32, as best seen in FIG. 4. Insert end piece 42 fits within the end section of port 86 and abuts conductive insert 88. Probe 46 extends through the open end of end piece 42 and insert casing 38 into inner bore 22 and engages female contact assembly 24. Once the first electrical connector is fully mated with second electrical connector 18, second end section 28 of connector 10 can be attached to a bushing well (not shown) of a piece of electrical equipment of the system. When the system is energized, the cable of connector 18 energizes probe 46 and female contact assembly 24 to energize the electrical equipment via the connection between female contact assembly 24 and the bushing well, as is well known in the art.

Cuff 94 of connector 18 is received in steps 74 defined between each radial rib 12, 14 and 16 and face wall 56 of transition shoulder 32 of electrical connector 10. End wall 98 of cuff 94 abuts or is slightly spaced from abutment surfaces 76 of each of radial ribs 12, 14 and 16 when connectors 10 and 18 are properly mated, as seen in FIG. 4. Each rib 12, 14 and 16 extends beyond any portion of body 20 of electrical connector 10 and cuff 94 of connector 18, as seen in FIG. 4, so the outer wall 68 of each rib 12, 14 and 16 is radially higher or beyond cuff 94. This prevents cuff 94 of second connector 18 from covering ribs 12, 14 and 16 of connector 10 when mating connectors 10 and 18.

An operator can determine whether electrical connector 10 and second electrical connector 18 are properly mated by observing the distance between first end walls 64 of ribs 12, 14 and 16 and end wall 98 of cuff 94 of second connector 18. If an operator observes that end wall 98 is abutting or is only slightly spaced from abutment surfaces 76 of rib end walls 64, then connectors 10 and 18 are properly and fully mated. For example, is the distance or space between rib end walls 64 and cuff end wall 98 is between about 0 and ¼ of an inch then connectors 10 and 18 are properly mated. Conversely, if abutment surfaces 76 and end wall 98 are more than slightly spaced from one another, then connectors 10 and 18 are improperly mated. The location, separation and size of ribs 12, 14 and 16 allow the operator to observe the relative distance between rib abutment surfaces 76 and cuff end wall 98 from any side or end of the connector assembly 20. For example, as seen in FIG. 4, an operator viewing assembly 20 from the side can observe the distance between abutment surfaces 76 of connector 10 and cuff end wall 98 of connector 18, as seen in FIG. 4. The operator can also observe the relative distance between rib abutment surfaces 76 and cuff end wall 98 from either end of the connector assembly 20. When observing assembly 20 from the end of first connector 10, the operator can see between ribs 12, 14 and 16 whether cuff end wall 98 of connector 18 is abutting abutment surfaces 76 of ribs 12, 14 and 16. Similarly, when observing assembly 20 from the end of second connector 18, because ribs 12, 14 and 16 extend beyond or are higher than cuff 94 the operator can see whether cuff 94 is abutting abutment surfaces 76 of ribs 12, 14 and 16.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

an elongated body with first and second end sections, a mid-section disposed between said first and second end sections, and a transition shoulder disposed between said first end section and said mid-section, said mid-section being radially larger than each of said first and second end sections and including an outer surface, said transition shoulder including a face wall extending between said outer surface of said mid-section and an outer surface of said first end section; and a plurality of radial indicator ribs circumferentially spaced about and extending axially alone and radially outwardly from said outer surface of said mid-section, each of said radial indicator ribs including an abutment surface laterally offset from said face wall of said transition shoulder and adapted to abut a portion of a mating electrical connector receiving said first end section, and a ground connection extending outwardly from said mid-section and remote of said abutment surfaces of said plurality of radial indicator ribs.

2. An electrical connector according to claim 1, wherein each of said abutment surfaces of said radial indicator ribs forms a step with said face wall of said transition shoulder adapted to receive the portion of the mating electrical connector.

3. An electrical connector according to claim 1, wherein each of said radial indicator ribs extends outwardly from said mid-section of said body radially beyond all portions of said body.

4. An electrical connector according to claim 1, wherein each of said abutment surfaces of said radial indicator ribs are substantially perpendicular to said outer surface of said mid-section in transverse cross-section of said body.

5. An electrical connector according to claim 1, wherein said body is formed of a dielectric material; and said mid-section includes an outer conductive jacket.

6. An electrical connector according to claim 1, wherein each said radial indicator ribs is formed as a unitary one-piece member with said outer conductive jacket.

7. An electrical connector according to claim 1, wherein said mating electrical connector is a high voltage cable connector.

8. An electrical connector, comprising:

an elongated body with first and second end sections, a mid-section disposed between said first and second end sections, and a transition shoulder disposed between said first end section and said mid-section, said mid-section being radially larger than each of said first and second end sections and including an outer surface, said transition shoulder including a face wall extending between said outer surface of said mid-section and an outer surface of said first end section; and a plurality of radial indicator ribs circumferentially spaced about and extending axially along and radially outwardly from said outer surface of said mid-section, each of said plurality of radial indicator ribs including an abutment surface laterally offset from and substantially parallel to said face wall of said transition shoulder defining a step therebetween adapted to receive a portion of a mating electrical connector receiving said first end section with substantially no space between the portion of the mating electrical connector and said abutment surfaces of said plurality of radial indicator ribs, and a ground connection extending outwardly from said mid-section and remote of said abutment surfaces of said plurality of radial indicator ribs.

9. An electrical connector according to claim 8, wherein the portion of the mating electrical connector abuts said abutment surface of said radial indicator rib.

10. An electrical connector according to claim 8, wherein said plurality of radial indicator ribs extends radially outwardly from said mid-section of said body beyond all portions of said body.

11. An electrical connector according to claim 8, wherein said mid-section includes an outer conductive jacket; and said plurality of radial indicator ribs forms a unitary one-piece member with said outer conductive jacket.

12. An electrical connector according to claim 8, wherein said mating electrical connector is a high voltage cable connector.

13. An electrical connector assembly, comprising:

a first electrical connector including an elongated body with first and second end sections, a mid-section disposed between said first and second end sections, and a transition shoulder disposed between said first end section and said mid-section, said mid-section being radially larger than each of said first and second end sections and including an outer surface, said transition shoulder including a face wall extending between said outer surface of said mid-section and an outer surface of said first end section, and a plurality of radial indicator ribs circumferentially spaced about and extending axially along and radially outwardly from said outer surface of said mid-section, each of said plurality of radial indicator ribs including an outer surface and an abutment surface laterally offset from said face wall of said transition shoulder defining a step therebetween, and a ground connection extending outwardly from said mid-section and remote of said abutment surfaces of said plurality of radial indicator ribs; and a second electrical connector including a port receiving said first end section of said first electrical connector and a cuff terminating said port, said cuff being received in said step of said first connector with an end portion of said cuff in close proximity with said abutment surfaces of said plurality of radial indicator ribs.

14. An electrical connector assembly according to claim 13, wherein said abutment surfaces of said plurality of radial indicator ribs are substantially parallel to said face wall of said transition shoulder.

15. An electrical connector assembly according to claim 13, wherein said abutment surfaces of said plurality of radial indicator ribs is are disposed on a wall of said rib that extends radially outwardly from said mid-section beyond said cuff of said second electrical connector and beyond any portion of said first electrical connector.

16. An electrical connector assembly according to claim 13, wherein said cuff of said second electrical connector covers said step without covering said outer surfaces of said plurality of radial indicator ribs.

17. An electrical connector assembly according to claim 13, wherein each of said plurality of radial indicator ribs is molded to said mid-section of said first electrical connector.

18. An electrical connector assembly according to claim 13, wherein said first electrical connector is a high-voltage bushing insert and said second electrical connector is a high-voltage cable connector.

19. A method of mating first and second electrical connectors, the first connector including first and second end sections with a mid-section therebetween and a transition shoulder disposed between the first end section and the mid-section, and the second connector including a port sized to accommodate the first end section of the first electrical connector and a cuff terminating the port, comprising the steps of:

inserting the first end of the first electrical connector into the port of the second electrical connector;

covering an outer surface of the transition shoulder of the first electrical connector with the cuff of the second electrical connector; and placing an surface of the cuff of the second electrical connector in close proximity with an abutment surface of each of a plurality of radial indicator ribs circumferentially spaced about and extending axially along and radially outwardly from an outer surface of the mid-section of the first electrical connector and laterally offset from the transition shoulder of the first electrical connector, thereby indicating proper mating between the first and second connectors, the mid-section having a ground connection extending outwardly therefrom and remote of said abutment surfaces of said plurality of radial indicator ribs.

20. A method of mating first and second electrical connectors according to claim 19, wherein said first electrical connector is a high voltage bushing insert and said second electrical connector is a high voltage cable connector.

* * * * *